United States Patent [19]

Goldstein et al.

[11] Patent Number: 4,683,187

[45] Date of Patent: Jul. 28, 1987

[54] DRY PROCESS ELECTROSTATIC DEVELOPER COMPRISING A GENERALLY ROUND MAGNETIC CARRIER AND A FLAKE-TYPE CARRIER

[76] Inventors: Amnon Goldstein, 767 Pelhamdale Ave., Pelham, N.Y. 10803; John F. Cooper, 9 Southwood Dr., Londonderry, N.H. 03053

[21] Appl. No.: 764,417

[22] Filed: Aug. 9, 1985

Related U.S. Application Data

[63] Continuation-in-part of Ser. No. 674,621, Nov. 26, 1984, abandoned.

[51] Int. Cl.[4] ..... G03G 13/09

[52] U.S. Cl. ..... 430/106.6; 252/62.51; 430/108

[58] Field of Search ..... 430/108, 137, 110, 106.6; 252/62, 51

[56] References Cited

U.S. PATENT DOCUMENTS

| | | | |
|---|---|---|---|
| 2,965,573 | 12/1960 | Gundlach | 430/108 |
| 4,179,388 | 12/1979 | Rahn et al. | 430/108 |
| 4,287,287 | 9/1981 | Bolte | 430/108 |
| 4,578,337 | 3/1986 | Oka | 430/107 |

*Primary Examiner*—John L. Goodrow

*Attorney, Agent, or Firm*—Darby & Darby

[57] ABSTRACT

An improved magnetic brush developer material utilizes toner material in combination with round carrier particles mixed in a particular proportion with flake carrier material. As a result of this combination of two carrier materials, the developed image has good line definition as well as good image area fill.

9 Claims, No Drawings

DRY PROCESS ELECTROSTATIC DEVELOPER COMPRISING A GENERALLY ROUND MAGNETIC CARRIER AND A FLAKE-TYPE CARRIER

This application is a continuation-in-part of U.S. patent application Ser. No. 674,621 filed on Nov. 26, 1984 now abandoned.

BACKGROUND OF THE INVENTION

This invention relates to xerographic development and, more particularly, multi-component developer materials.

In electrophotographic processes, there are a number of well known methods of developing the electrostatic image which is created on the photoconductor drum. These include cascade development, powder cloud development and magnetic brush development. All of these systems have as an object to transfer toner particles to the photoconductor drum so that they adhere to the electrostatic image and can later be transferred to and fused with paper.

In magnetic brush development, a cylinder which may be magnetic is rotated in close proximity to the photoconductor. A portion of the cylinder passes through a reservoir containing magnetic developer material. As a result, this material is attracted to the cylinder and rotates with it in the form of a brush or a tuft of material that is pulled across the photoconductor surface. Originally, the developer was a two component material in which toner was mixed with a magnetic carrier material. However, in recent years, attempts have also been made to produce a one-component developer material wherein the toner has magnetic properties.

When toner is used with carrier material, the developer is tumbled in the reservoir. As a result, the toner develops triboelectric charge and is attracted to the carrier. The toner and carrier are then carried against the photoconductor drum and tumble along the surface so that the toner particles are attracted to the charged image on the photoconductor and stick to it, as opposed to staying with the carrier. The carrier particles continue to be attracted to the cylinder and are returned to the reservoir.

It is well known that when round or shot carrier is used in a developer mix, the final image has good line definition but it does not fill large areas very well. Examples of this type of carrier are described in U.S. Pat. No. 4,331,757 of Tanaka, et al.

It is also known in the art to use flake or irregular carrier. See for example U.S. Pat. No. 3,278,439 of Blanchette. With such carrier, there is better image fill because it creates hot spots, but edge definition is not very good. Attempts have been made to improve developer performance with very irregular shapes for shot carrier, for example, a sponge-like shot carrier.

U.S. Pat. No. 2,965,573 of Gundlach suggests a combination of spherical carriers and cylindrical non-magnetic and electrically conductive filaments. Such a developer mix, while useful in cascade development systems, is not useful in magnetic brush development. The non-magnetic property would inhibit the formation of the chains of carrier particles that create the magnetic brush and the conductive property may tend to short out the magnetic cylinder. Consequently, the various shortcomings of the available developer materials have not been entirely overcome.

SUMMARY OF THE INVENTION

The present invention is directed to the provision of a developer material that has good line definition and area fill. This object is achieved by utilizing a toner material in combination with both resistive flake carrier and higher resistivity ferrite carrier, e.g. flake carrier and spherical ferrite shot carrier.

In an illustrative embodiment of the invention, a toner, such as carbon-filled resin, is used in combination with a carrier mixture wherein the ratio of shot carrier to flake carrier as measured by weight, is from 1:3 to 3:1. With such an arrangement, thoroughly mixed, the flake carrier adequately develops the image area and the shot carrier at the same time provides good line definition. Also, the two carriers work together to achieve a synergistic effect in terms of improved image density.

DESCRIPTION OF EXEMPLARY EMBODIMENTS

According to the present invention, a developer material for use in an electrophotographic process utilizes a single toner or groups of toners in combination with at least two distinctly different magnetic carrier materials. These materials are resistive flake and more resistive ferrite, preferably flake carrier and shot carrier. As is well known, the shot carrier gives good line definition in the finished document but fails to provide good area fill.

Flake carrier, which may be iron filings, has a large surface area, but also has very sharp points and edges. In an electrostatic environment the sharp points and edges intensify the field lines produced over large charged areas and tend to attract toner to these areas from the carrier surface. Further, these sharp points tend to eliminate charge and the elimination of charge allows for better image area fill. Also, the lower resistivity of the flake compared to the shot enhances the image field which improves the area fill.

With a mixture of round shot and flake carriers of the type described, both good edge definition and image area fill are achieved. Also, the performance of the toner can be varied by changing the proportion of the shot and flake carrier. In particular, the proportion of shot to flake can be varied from 1:5 to 5:1, preferably 1:3 to 3:1. When the ratio is 1:5 the line definition is not as good, and the area fill is not as good with a 5:1 ratio. The best performance is with a ratio of 1:1 by weight.

The particle size can also vary over a range from 325 sieve to 150 sieve with a preferred average distribution of from 325 sieve to 230 sieve. The resistivity of the carriers should be in the range of $10^5$ to $10^{10}$ ohm-centimeters, with the ferrite shot being more resistive than the flake. Further the ratio of toner to carrier should preferably be in the range of 4 to 10%.

EXAMPLE NO. 1

An experiment was conducted in developing an electrostatic image using a magnetic brush developer unit and a developer material according to the present invention. This developer material utilized 7% commercially available Sharp 90T toner and a mixture of carrier particles which was in the ratio of 2 to 1 by weight of shot carrier to flake carrier. The resistivity of the ferrite shot carrier was approximately $10^8$ ohm centimeters and the resistivity of the flake carrier was approximately $10^5$ ohm centimeters. The result was a well developed image with good line definition and good area fill.

EXAMPLE NO. 2

Another combination of the toner material of Example 1 was made with carrier in the ratio of 1:1 shot carrier to flake carrier by weight. In this case, the image differed from that in Example 1 in that the area fill was even better and the line definition was not degraded.

EXAMPLE NO. 3

A further developer mix was tested in which the toner was the same as in Example 1 and the shot and flake proporations were 3:1. In this case, the developed image had good line definition and satisfactory, but reduced, area fill.

EXAMPLE NO. 4

A developer mix was tested utilizing 7% Memorex BDC-297 toner which has a higher charge to mass ratio than Sharp 90T. The shot and flake carriers of Example 1 were used in the range of 3:1 and good results were achieved. The ratio was then changed to 5:1 and in that case the image had good line definition and satisfactory, but reduced, area fill.

EXAMPLE NO. 5

A further developer mix was tested in which the toner was the same as in Example No. 4 and the shot and flake carriers were the same, but in the ratio of 1:3. Here the area fill improved over Example No. 4 without significant loss of line definition. When the ratio was changed to 1:5 there was a satisfactory, but reduced line definition.

Thus, it can be seen that by utilizing two distinctly different types of carrier, improved electrophotographic development is achieved.

Also it is believed that as the charge to mass ratio of the toner increases, the ratio of shot to flake carrier can be increased, while still achieving satisfactory results.

Beyond the edge performance characteristics of the shot material and the area fill characteristics of the flake material, there is a clearly synergistic effect in terms of improved image density. Image density was measured with a TA Optical Densitometer RBX for different percentages of toner in the developer mix, as well as for shot carrier alone, flake carrier alone and a 1:1 ratio of shot to flake. The following data was obtained:

| Optical Density Measurements | | | | |
|---|---|---|---|---|
| Percentage Toner | 2% | 4% | 8% | 10% |

-continued

| Optical Density Measurements | | | | |
|---|---|---|---|---|
| Shot | 0.7 | 0.9 | 1.0 | 1.1 |
| Development | halo | halo | halo | less halo, too much background |
| Flake | 0.9 | 1.2 | 1.4 | 1.5 |
| Shot/flake | 1.1 | 1.4 | 1.7 | 1.7 |

wherein "halo" development means the edges are sharp and black, but the body of the image has a lower density. This shows that for the same percentage of toner to developer, the shot and flake mix produces a denser image than with either shot or flake carriers alone.

While the present invention has been particularly shown and described with reference to preferred embodiments thereof, it will be understood by those skilled in the art that various changes in form and details may be made therein without departing from the spirit and scope of the invention.

We claim:

1. An electrophotographic magnetic brush developer material comprising:

a toner material, a round magnetic carrier material having a generally round cross section, and a flake type magnetic carrier material, the proportion of round carrier material to flake carrier material by weight being in the range of from 1:5 to 5:1.

2. A developer material as claimed in claim 1 wherein the proportion of round carrier material to flake carrier material is in the range of from 1:3 to 3:1.

3. A developer material as claimed in claim 1 wherein the proportion of round carrier material to flake carrier material is 1:1.

4. A developer material as claimed in claim 1 wherein the percentage of toner to carrier is in the range of 4 to 10% by weight.

5. A developer material as claimed in claim 1 wherein the proportion of round carrier material to flake carrier material by weight is varied as a function of the charge to mass ratio of the toner.

6. A developer material as claimed in claim 1 wherein the round carrier material is ferrite shot having a certain resistivity and the flake-type carrier has a resistivity less than that of the ferrite shot.

7. A developer material as claimed in claim 6 wherein the resistivity of the two carrier materials is in the range of $10^5$ to $10^{10}$ ohm-centimeters

8. A developer material as claimed in claim 7 wherein the proportion of shot carrier material to flake carrier material is in the range of from 1:3 to 3:1.

9. A developer material as claimed in claim 8 wherein the percentage of toner to carrier is in the range of 4 to 10% by weight.

* * * * *